US005758841A

United States Patent [19]

Ayffre et al.

[11] Patent Number: 5,758,841

[45] Date of Patent: Jun. 2, 1998

[54] SPINDLE CAPABLE OF BEING INSERTED INTO THE CORE OF A ROLL OF MATERIAL IN STRIP FORM AND MACHINE FOR WINDING AND/OR UNWINDING COMPRISING SUCH SPINDLES

[75] Inventors: Jean-Paul Ayffre, Paris; Robert Jean Malinie, Saint Michel Sur Orge, both of France

[73] Assignee: Materiels Equipements Graphiques, France

[21] Appl. No.: 797,349

[22] Filed: Feb. 11, 1997

[30] Foreign Application Priority Data

Feb. 12, 1996 [FR] France ..... 96 01685

[51] Int. Cl.[6] ..... B65H 75/24

[52] U.S. Cl. ..... 242/423.1; 242/571.5; 242/571.6; 242/575.3

[58] Field of Search ..... 242/423.1, 423.2, 242/571.3, 571.4, 571.5, 571.6, 571.7, 575.3

[56] References Cited

U.S. PATENT DOCUMENTS

| | | | |
|---|---|---|---|
| 1,492,291 | 4/1924 | Giovannoni et al. | 242/571.6 |
| 2,053,815 | 9/1936 | Panthou et al. | 242/571.6 |
| 2,902,232 | 9/1959 | Jacobsen | 242/423.2 |
| 3,355,121 | 11/1967 | Wright . | |
| 3,837,591 | 9/1974 | Clarke | 242/423.1 |
| 3,999,721 | 12/1976 | DuFresne | 242/571.5 |
| 4,645,136 | 2/1987 | Woodley et al. | 242/571.5 |
| 4,893,765 | 1/1990 | Randolph | 242/571.6 |
| 5,628,475 | 5/1997 | Warnaar | 242/571.4 |

FOREIGN PATENT DOCUMENTS

| | | |
|---|---|---|
| 0121996 | 10/1984 | European Pat. Off. . |
| 1294568 | 1/1972 | United Kingdom . |

*Primary Examiner*—John M. Jillions
*Attorney, Agent, or Firm*—Mitchell D. Bittman

[57] ABSTRACT

The present invention relates to a spindle capable of being inserted into a core (1) on which a material in strip form, in particular paper, is wound into a roll. This spindle comprises a shaft (8) connected to a braking device (7), a tubular jaw holder (9) that is rotatable with the shaft, jaws (12) housed in longitudinal slots (13) provided in the jaw holder, elastic members (14) bringing the jaws into engagement with the inner surface of the core (1) when the spindle is inserted into the latter, and complementary clamping means (21) for reinforcing the action of the elastic members (14) on the jaws (12) at the time of braking, acceleration or deceleration of the roll (2), the core (1) of which is borne on the spindle.

The present invention also relates to a machine for winding and/or unwinding a material in strip form, the spindles of which are of the structure defined hereabove.

6 Claims, 3 Drawing Sheets

SPINDLE CAPABLE OF BEING INSERTED INTO THE CORE OF A ROLL OF MATERIAL IN STRIP FORM AND MACHINE FOR WINDING AND/OR UNWINDING COMPRISING SUCH SPINDLES

The present invention relates to a spindle capable of being inserted into a core having a cylindrical inner surface and onto which a material in strip form, in particular paper, is wound to form a roll, the said spindle comprising a shaft connected to a braking device, a tubular jaw holder having an outer terminal portion which is free and an inner terminal portion which is borne by the shaft, the jaw holder being rotatable with said shaft, jaws housed in longitudinal slots provided in the outer terminal portion of the jaw holder, elastic members biasing the jaws radially outwardly so that they come into engagement with the inner surface of the core when the spindle is inserted into said core, and retaining means provided on the ends of the jaws to prevent the latter from escaping from the longitudinal grooves when the spindle is outside the core.

Many machines used for winding or unwinding strips of material of small thickness, in particular strips of paper, comprise spindles of this type.

These spindles are designed to be introduced into the ends of the cores, generally made of cardboard, supporting the material wound into a roll, and to come into engagement with the inner surface of the cores in order to enable the rolls to be driven in rotation.

Experience has shown, however, that, when a roll is braked with a view to unwinding the material at a constant speed, or when it is subjected to acceleration or deceleration, the spindles do not remain engaged with the core, and rotate at a speed different from that of the core, which can more or less seriously disturb the operation of the winding and/or unwinding machine.

The present invention proposes to offer a solution to this problem and, to do so, it provides a spindle having the structure indicated in the introduction and which is characterised in that it further comprises complementary clamping means to reinforce the biasing action exerted by the elastic members upon the jaws at the time of braking, acceleration or deceleration of the roll the core of which is borne on the spindle.

Thanks to these complementary clamping means, the spindles introduced into the two ends of a roll core always remain in engagement with the inner surface thereof.

The spindles and the core thus continue to rotate at the same speed, both when the roll is braked during unwinding at constant speed and when it is subjected to accelerations or decelerations.

According to one particular form of embodiment of the invention, the complementary clamping means include a polygonal rod rotatable with the shaft, the said rod extending inside the jaw holder and having longitudinal faces separated by edges, as well as means for permitting limited relative rotation between the jaw holder and the rod so that each jaw can move between a normal clamping position, in which it bears against a predetermined longitudinal face of the rod when the roll is immobilised or rotates at a low torque and at constant speed, and an intensified clamping position, in which it bears against an edge adjacent to the predetermined longitudinal face of the rod when the roll is braked, accelerated or slowed down.

The jaws exert on the inner surface of the core an externally directed action which is clearly greater when they bear against the edges of the rod than when they bear against the longitudinal faces thereof.

It is to be noted here that the displacement of the jaws between their normal clamping position and their intensified clamping position is ensured automatically when the roll is braked, accelerated or slowed down.

To prevent the jaws from coming to bear against the following longitudinal face of the rod, the means permitting limited relative rotation between the jaw holder and the rod can comprise at least one longitudinal rib projecting from the outer lateral surface of the shaft and extending into a longitudinal groove provided in the inner lateral surface of the jaw holder, the rib being located equidistantly from the longitudinal faces of the groove, when the jaws are in their normal clamping position, and bearing against one of the longitudinal faces of the groove when the jaws are in their intensified clamping position.

According to an alternative form of embodiment, the means permitting limited relative rotation between the jaw holder and the rod include protuberances projecting from the inner face of a cover fixed to the end of the outer terminal portion of the jaw holder, and bosses provided on the transverse faces of the jaws that are adjacent to the cover, the protuberances and the bosses being positioned in such a way as to provide a space between them when the jaws are in their normal clamping position, and to be in contact when the jaws are in their intensified clamping position.

The spindle according to the invention is further characterised in that the elastic members are constituted by helicoidal springs arranged in blind holes provided in the jaws, the springs bearing against the rod, holding the jaws away from the rod when the outer terminal portion of the jaw holder is outside the core, and being withdrawn into the blind holes, allowing the jaws to bear directly against the rod, when the outer terminal portion of the jaw holder is inside the core.

The present invention also relates to a machine for winding and/or unwinding a material in strip form, comprising two spindles capable of being inserted into a core on which the material in strip form forms a roll, at least one of the two spindles possessing the characteristics defined hereabove.

One form of embodiment of the present invention will be described hereinafter by way of an in no manner limitative example, with reference to the annexed drawings, wherein.

Figure 1:
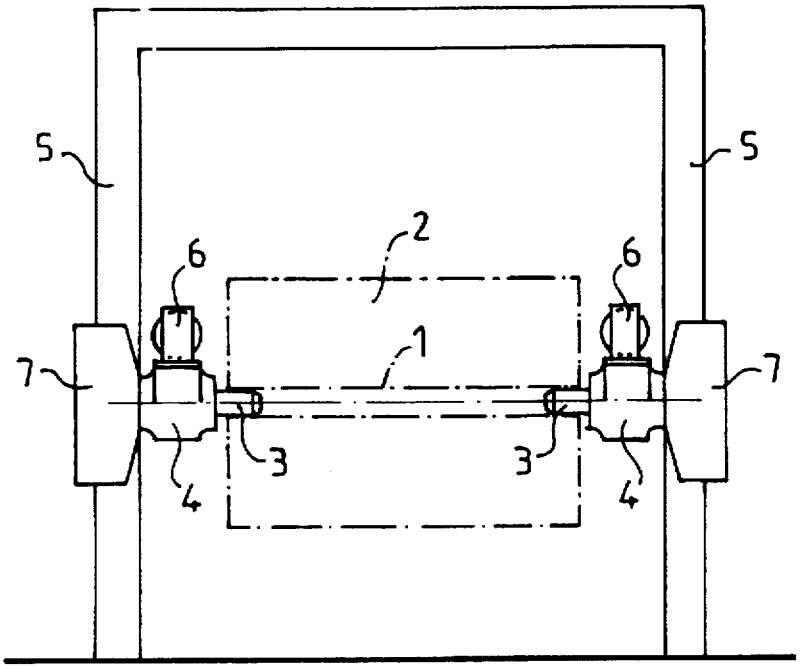
FIG. 1 is a schematic side view of a winding and/or unwinding machine comprising two spindles according to the invention.

The machine diagrammatically shown in FIG. 1 has been developed for winding and/or unwinding a strip of paper, but there is no reason why the strip should not be made of another material of approximately the same thickness.

The strip of paper is wound onto a core 1 of cardboard and forms a roll 2 supported by two coaxial spindles 3, the free ends of which are directed towards one another and which are located in the end portions of core 1.

Spindles 3 are borne by two parallel arms 4 capable of being displaced in translation along a shaft, not shown, extending horizontally between the two uprights 5 of the frame of the machine.

The shaft, which is parallel to spindles 3, enables the two arms to be moved towards or away from one another and their distance to be adapted to the width of the roll of paper to be wound or unwound.

Spindles 3 are mounted rotatably on the two arms 4 and can be driven in rotation by control means, not shown. They comprise an active portion, axially displaceable under the control of a motor member 6. More precisely, the motor members 6 are provided for retracting the active portions of the spindles into the arms in order to extract these portions from the core of the roll, or for causing them to emerge from the arms, in order to introduce them into the core of a new roll.

Two braking devices 7, to be discussed hereinafter, are further provided to brake roll 2 supported by the two spindles 3.

Figure 3:
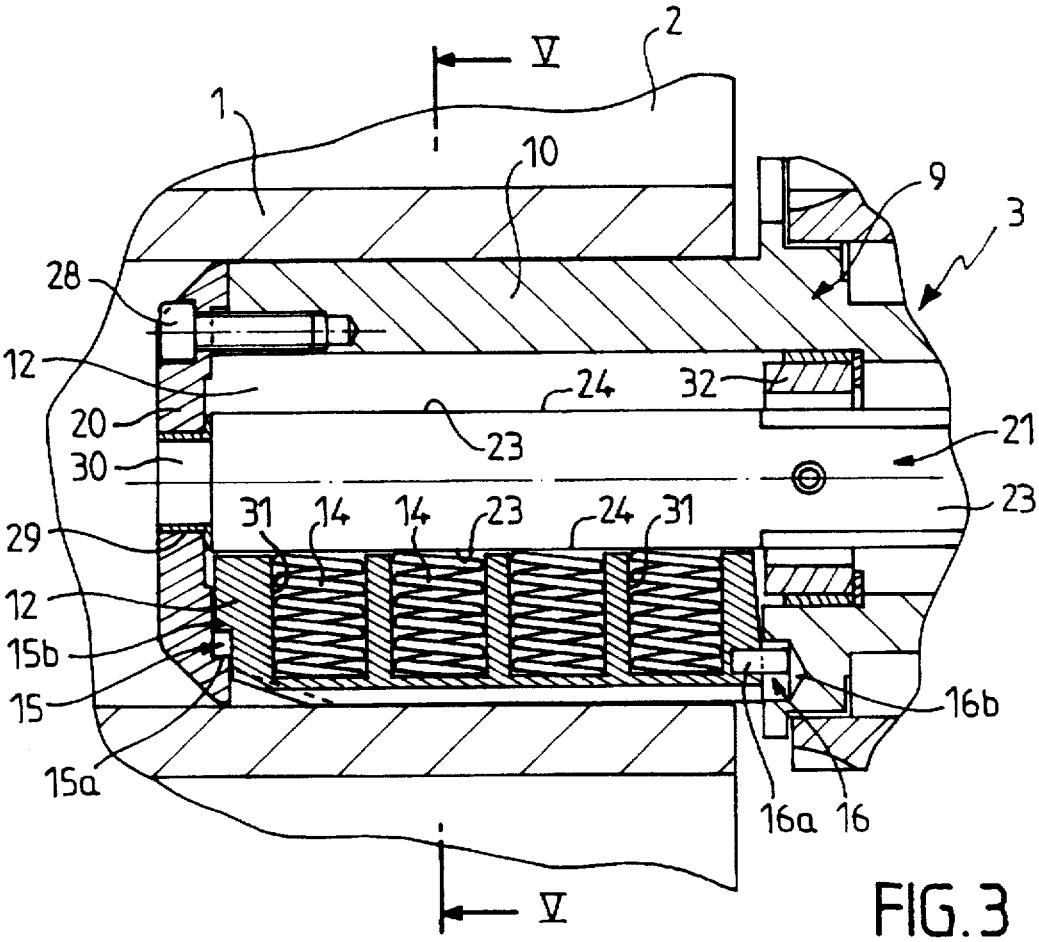
FIG. 3 is a larger scale cross-sectional view of the free end of the spindle visible in FIG. 2.
Figure 2:
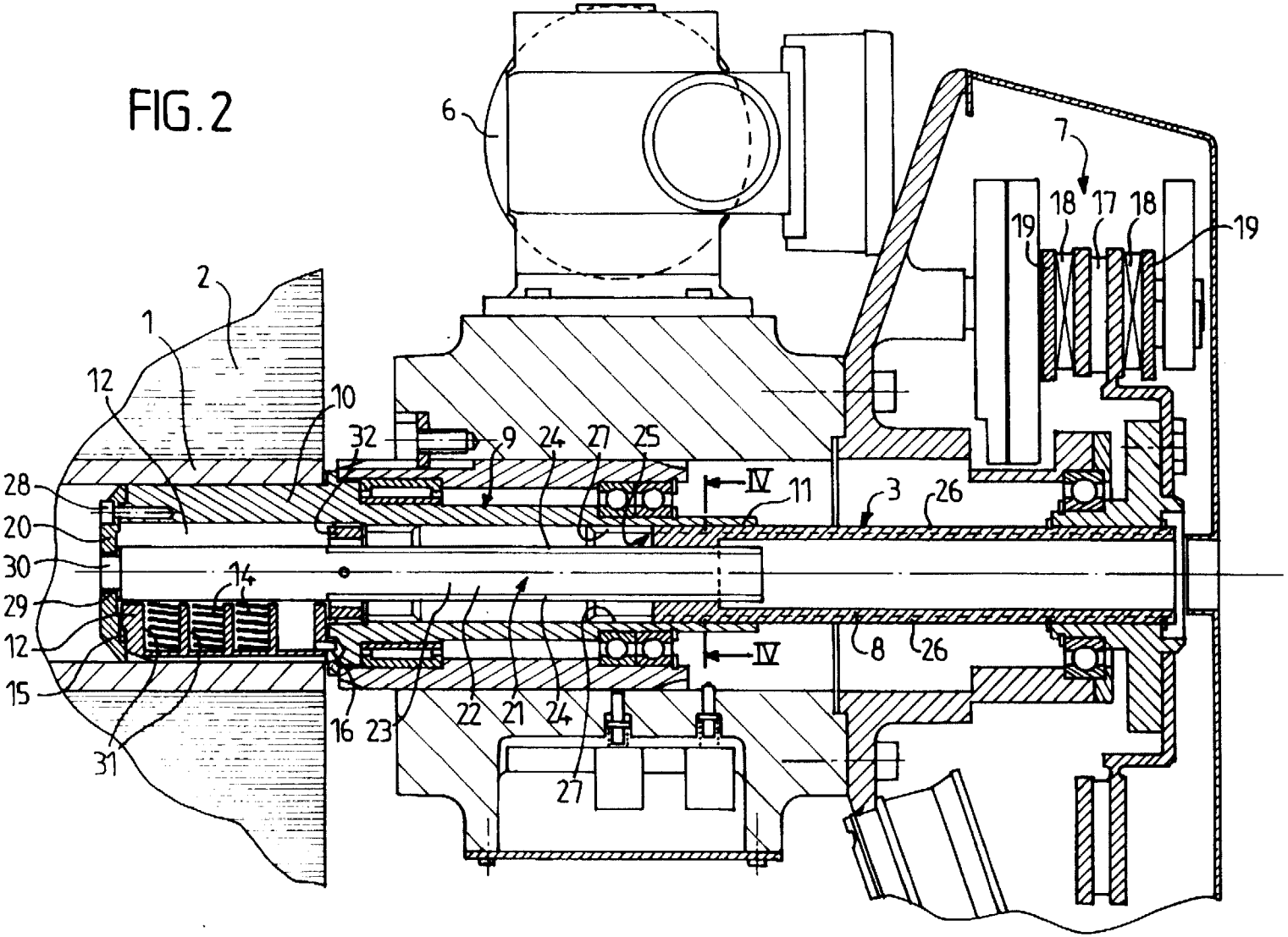
FIG. 2 is a cross-sectional view of a spindle according to the invention, the jaws of which are introduced into one of the ends of a core on which a material in strip form has been wound into a roll.
Figure 5:
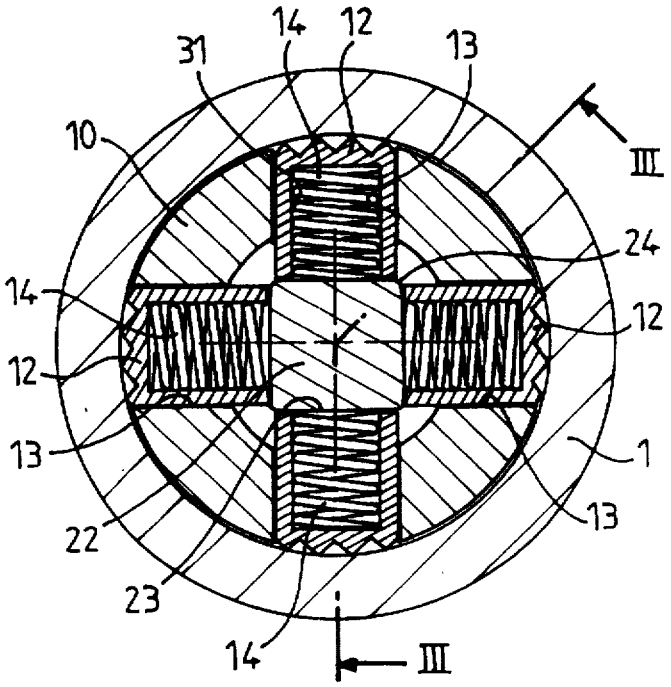
FIG. 5 is a cross-sectional view along line V—V of FIG. 3.

As can be seen from FIGS. 2, 3 and 5, spindles 3 each comprise a shaft 8 connected to the corresponding braking device 7, a tubular jaw holder 9 having an outer terminal portion 10 and an inner terminal portion 11 fitted onto shaft 8, four jaws 12 housed in longitudinal slots 13 provided in the outer terminal portion 10 of jaw holder 9, elastic members 14 biasing the jaws 12 radially outwardly, and retaining means 15, 16 provided at the two ends of the jaws 12 to prevent the latter from escaping from the longitudinal grooves 13 when the active portion of jaw holder 9 is outside the core.

Shaft 8 is hollow and bears, in the vicinity of its end that is opposite jaw holder 9, the rotary portion of the corresponding braking device 7. As the latter is of conventional design, it will not be described in detail here. It is simply pointed out that its rotary portion comprises a disk 17 located between two fixed linings 18, and that the linings are designed to be pressed against the disk by two fixed pistons 19 through the action of a fluid under pressure, such as oil or compressed air.

Jaw holder 9 is rotatable with shaft 8 while being axially displaceable axially thereon. Its outer terminal portion 10 can, in fact, be introduced into core 1, or be extracted therefrom, through the action of the corresponding motor member 6, which has to be caused to run in the appropriate direction.

When terminal portion 10 is in the core, as shown in FIGS. 2, 3 and 5, jaws 12 are strongly biased by elastic members 14 against the inner surface of the core, which enables them to transmit their rotational movement to the roll 2.

As regards retaining means 15 and 16, these are of conventional design and will not be described in detail.

By way of information, it is pointed out, however, that the means 15, which are located on the outer end side of the jaws, are formed, on one hand, by protuberances 15*a* adjacent to the periphery of the inner face of a cover 20 fixed to the free end of jaw holder 9 and, on the other hand, by bosses 15*b* provided on the jaws in such a way as to be radially inside protuberances 15*a*.

It is also pointed out that means 16, which are located on the inner end side of the jaws, are formed by pins 16*a* borne by the jaws and by notches 16*b* provided in jaw holder 9 and into which the pins project.

It will easily be appreciated that, thanks to their special structure, retaining means 15 and 16 prevent jaws 12 from escaping from longitudinal slots 13 in the jaw holder when the terminal portion 10 of the latter is outside core 1.

When a roll of paper supported by two conventional spindles is subjected to acceleration or to deceleration, or when it is braked in order to rotate at constant speed during an unwinding operation, it may happen that the elastic members do not bias the jaws strongly enough against the inner surface of the core to prevent the roll from rotating at a speed different from that of the jaw holder.

To prevent such a difference in speed of rotation, each of the spindles according to the invention comprises complementary clamping means 21 designed to reinforce the action exerted upon by elastic members 14 on jaws 12.

In the form of embodiment shown, clamping means 21 include a square rod 22 rotatable with shaft 8. This rod, one of the ends of which is fitted into shaft 8, and the other end of which extends from the free end of jaw holder 9, comprises four longitudinal faces 23 separated by edges 24.

Clamping means 21 also include means 25 to permit limited relative rotation between jaw holder 9 and rod 22 so that each jaw 12 can move between a normal clamping position, in which it bears against a predetermined longitudinal face 23 of rod 22 when roll 2 is immobilised or rotates at low torque and at a constant speed, and an intensified clamping position, in which it bears against an edge 24 adjacent to the predetermined longitudinal face 23 when the roll is braked, accelerated or slowed down.

In the form of embodiment shown in FIGS. 1 to 6, the means 25 permitting limited relative rotation between jaw holder 9 and rod 22 include two longitudinal ribs 26 projecting from the outer lateral surface of shaft 8, these ribs being diametrically opposed and projecting into two longitudinal grooves 27 provided in the inner lateral surface of jaw holder 9.

Figure 4:
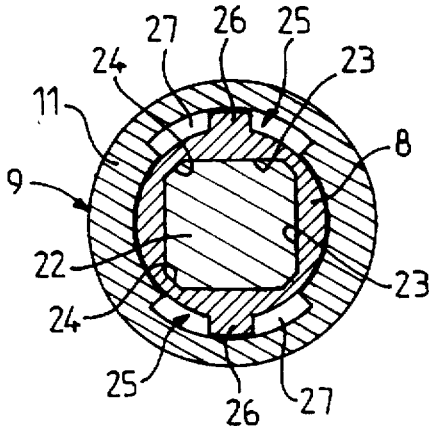
FIG. 4 is a cross-sectional view along line IV—IV of FIG. 2.

Ribs 26 are located equidistantly from the longitudinal faces of grooves 27 when jaws 12 are in their normal clamping position, as shown in FIG. 4. On the other hand, they bear against one of the longitudinal faces of the grooves 27 when jaws 12 are in their intensified clamping position.

The structure of means 25 permitting limited relative rotation between jaw holder 9 and rod 22 can be different from the one that has just been described.

Means 25 could, for example, be formed by protuberances 15*a* projecting axially from the inner face of cover 20 fixed to the free end of jaw holder 9, and by bosses 15*b* provided on the transverse faces of jaws 12 that are adjacent to the cover.

As indicated hereabove, protuberances 15*a* and bosses 15*b* form the retaining means 15 preventing jaws 12 from escaping from longitudinal slots 13 in the jaw holder. According to the invention, they could also have the function of permitting only limited relative rotation between jaw holder 9 and rod 22.

For this purpose, each protuberance 15*a* and boss 15*b* that is associated therewith should be positioned so as to provide between them a small space when jaws 12 are in their normal clamping position, in order to abut against one another when jaws 12 are in their intensified clamping position.

Figure 7:
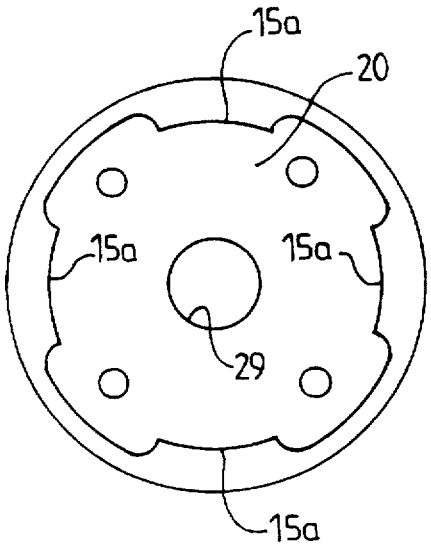
FIG. 7 is a view of the inner face of a cover capable of being installed in place of the one that is fixed to the free end of the spindle shown in FIGS. 1 to 6.
Figure 6:
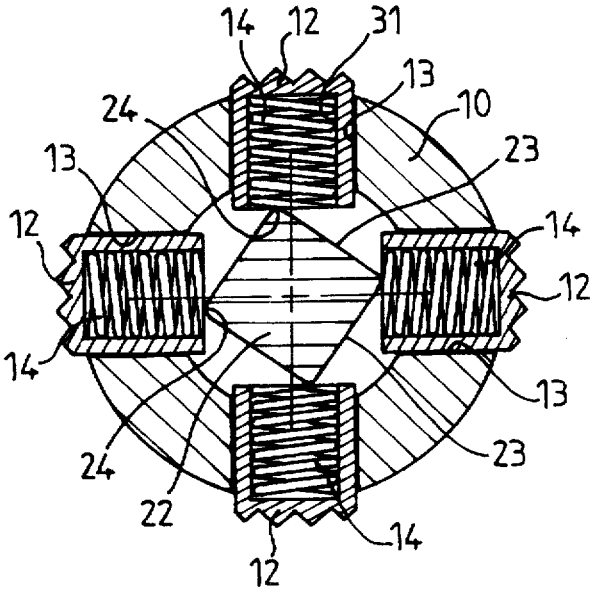
FIG. 6 is a view analogous to that of FIG. 5, but showing the jaws in their intensified clamping position, the core of the roll, to facilitate understanding of the invention, not being shown.

With particular reference to FIG. 7, it will be appreciated that it suffices to use a cover 20 the protuberances 15*a* of which project sufficiently radially inwardly to form means 25 with the bosses 15*b* of jaws 12.

For information, it is pointed out that cover 20 is fixed onto jaw holder 9 by four screws 28 and that it comprises a central hole 29 admitting a cylindrical boss 30 axially extending square rod 21.

It is further pointed out that the elastic members 14 are formed by helicoidal springs arranged in blind holes 31 provided in jaws 12. These springs bear against the longitudinal faces 23 of square rod 22, holding jaws 12 away from said rod when the terminal portion 10 of the jaw holder is outside the core. On the other hand, they are pushed right back into blind holes 31, enabling jaws 12 to bear directly against square rod 22, when terminal portion 10 is inside the core.

In the latter case, jaws 12 rest, in fact, against the longitudinal faces 23 of rod 22 when they are in their normal clamping position, and against edges 24 of rod 22 when they are in their intensified clamping position.

It should be noted, finally, that square rod 22 bears a ring 32 on which jaw holder 9 comes to bear and which enables the latter to remain coaxial with shaft 8 and rod 22.

In the form of embodiment just described, the jaw holder comprises four jaws. It goes without saying, however, that it would not be outside the scope of the present invention for the spindles to comprise more or fewer jaws. It would suffice to use a polygonal rod having at least as many longitudinal faces as jaws.

We claim:

1. Spindle capable of being inserted into a core (1) having a cylindrical inner surface and onto which a material in strip form, in particular paper, is wound to form a roll, the said spindle comprising a shaft (8) connected to a braking device (7), a tubular jaw holder (9) having an outer terminal portion (10) which is free and an inner terminal portion (11) which is borne by the shaft, the jaw holder being rotatable with the latter, jaws (12) housed in longitudinal slots (13) provided in the outer terminal portion (10) of the jaw holder, elastic members (14) biasing the jaws radially outwardly so that they come into engagement with the inner surface of the core (1) when the spindle is inserted into said core, and retaining means (15, 16) provided on the ends of the jaws to prevent the latter from escaping from the longitudinal grooves (13) when the spindle is outside the core, characterised in that it further comprises complementary clamping means (21) to reinforce the biasing action exerted by the elastic members (14) upon the jaws (12) at the time of braking, acceleration or deceleration of the roll (2) formed on the core (1).

2. Spindle according to claim 1, characterized in that the complementary clamping means (21) including a polygonal rod (22) rotatable with the shaft (8), the said rod extending inside the jaw holder (9) and having longitudinal faces (23) separated by edges (24), as well as means (25; 15*a*, 15*b*) for permitting limited relative rotation between the jaw holder and the rod so that each jaw (12) can move between a normal clamping position, in which it bears against a predetermined longitudinal face (23) of the rod when the roll (2) is immobilised or rotates at a low torque and at constant speed, and an intensified clamping position, in which it bears against an edge (24) adjacent to the predetermined longitudinal face of the rod when the roll (2) is braked, accelerated or slowed down.

3. Spindle according to claim 2, characterised in that the means (25) permitting limited relative rotation between the jaw holder (9) and the rod (22) comprise at least one longitudinal rib (26) projecting from the outer lateral surface of the shaft (8) and extending into a longitudinal groove (27) provided in the inner lateral surface of the jaw holder (9), the rib being located equidistantly from the longitudinal faces of the groove, when the jaws (12) are in their normal clamping position, and bearing against one of the longitudinal faces of the groove (27) when the jaws are in their intensified clamping position.

4. Spindle according to claim 2, characterised in that the means (15*a*, 15*b*) permitting limited relative rotation between the jaw holder (9) and the rod (22) include protuberances (15*a*) projecting from the inner face of a cover (20) fixed to the end of the outer terminal portion (10) of the jaw holder, and bosses (15*b*) provided on the transverse faces of the jaws (12) that are adjacent to the cover, the protuberances and the bosses being positioned in such a way as to provide a space between them when the jaws are in their normal clamping position, and to be in contact when the jaws are in their intensified clamping position.

5. Spindle according to any one of claims 2 to 4, characterised in that the elastic members (14) are constituted by helicoidal springs arranged in blind holes (31) provided in the jaws (12), the springs bearing against the rod (22), holding the jaws away from the latter when the outer terminal portion (10) of the jaw holder (9) is outside the core (1), and being pushed back into the blind holes, allowing the jaws to bear directly against the rod, when the outer terminal portion of the jaw holder is inside the core.

6. Machine for winding and/or unwinding a material in strip form, comprising at least two spindles capable of being inserted into a core (1) on which the material in strip form forms a roll (2), characterised in that at least one of the spindles is as defined in claim 1.

* * * * *